US008578743B2

(12) United States Patent
Yu

(10) Patent No.: US 8,578,743 B2
(45) Date of Patent: Nov. 12, 2013

(54) CABLE LOCK

(75) Inventor: Chang-Chiang Yu, Chung-Ho (TW)

(73) Assignee: Sinox Co., Ltd, Taipei County ( * ) Notice: Subject to any disclaimer, the term of this patent is extended or adjusted under 35 U.S.C. 154(b) by 177 days.

(21) Appl. No.: 12/770,865

(22) Filed: Apr. 30, 2010

(65) Prior Publication Data

US 2011/0174024 A1 Jul. 21, 2011

Related U.S. Application Data

(60) Provisional application No. 61/173,991, filed on Apr. 30, 2009.

(51) Int. Cl.
*E05B 37/02* (2006.01)

(52) U.S. Cl.
USPC ..... 70/30; 70/38 A; 70/49; 70/53

(58) Field of Classification Search
USPC ..... 70/30, 38 A, 49, 14, 18, 53, 233, 25, 26; 24/115 R, 115 M, 136 R
See application file for complete search history.

(56) References Cited

U.S. PATENT DOCUMENTS 351,063 A * 10/1886 McCormick ..... 70/65
695,458 A * 3/1902 Hulzer et al. ..... 70/15
866,965 A * 9/1907 Redding ..... 70/65
1,679,665 A * 8/1928 Junkunc ..... 70/260
1,901,613 A * 3/1933 Smith ..... 70/259
3,667,260 A * 6/1972 Foote ..... 70/159
4,038,845 A * 8/1977 Szlakman ..... 70/211
5,149,152 A * 9/1992 Lanius ..... 292/37
5,398,529 A * 3/1995 Goldman et al. ..... 70/38 A
5,901,586 A * 5/1999 Hale ..... 70/18
5,953,940 A * 9/1999 Ling ..... 70/25
6,360,571 B1 * 3/2002 O'Neal ..... 70/226
6,470,718 B1 10/2002 Yang
6,526,785 B1 * 3/2003 Asenstorfer et al. ..... 70/49
6,629,440 B1 * 10/2003 Meekma et al. ..... 70/49
7,104,093 B2 9/2006 Ling et al.
7,152,439 B1 * 12/2006 Chang ..... 70/30
7,246,511 B1 * 7/2007 Zhu ..... 70/38 R
7,526,932 B2 * 5/2009 Funtmann ..... 70/58
7,571,627 B2 * 8/2009 Yu ..... 70/21

(Continued)

*Primary Examiner* — Lloyd Gall

(57) ABSTRACT

A cable lock includes a belt, a lock body, a first clamp unit, a second clamp unit, and a switch unit. The belt has a buckle unit at one end thereof. The lock body has a hole for the belt to pass therethrough and a slot for receiving the buckle unit, wherein the belt and the lock body are together capable of forming a closed loop. The first clamp unit for fixing the belt in the hole is movably disposed in the lock body while the second clamp unit for retaining the buckle unit in the slot is movably disposed in the lock body. The switch unit is rotatably disposed on the lock body and capable of enabling the cable lock to operate in a locked mode, a clinched mode, or an unlocked mode. When the cable lock operates in the locked mode, the first clamp unit fixes the belt in the hole and the second clamp unit retains the buckle unit in the slot so that the closed loop has a fixed length. When the cable lock operates in the clinched mode, the first clamp unit releases the fixing of the belt to allow the closed loop to have an adjustable length. When the cable lock operates in the unlocked mode, the second clamp unit releases the buckle unit so that the belt can be detachable from the lock unit.

21 Claims, 11 Drawing Sheets

(56) References Cited

U.S. PATENT DOCUMENTS 7,617,706 B1 * 11/2009 Kuo ..... 70/58
7,784,313 B2 * 8/2010 Wyers ..... 70/49
2007/0094851 A1 * 5/2007 Yang ..... 24/115 R
2008/0314094 A1 * 12/2008 Shu ..... 70/30

* cited by examiner

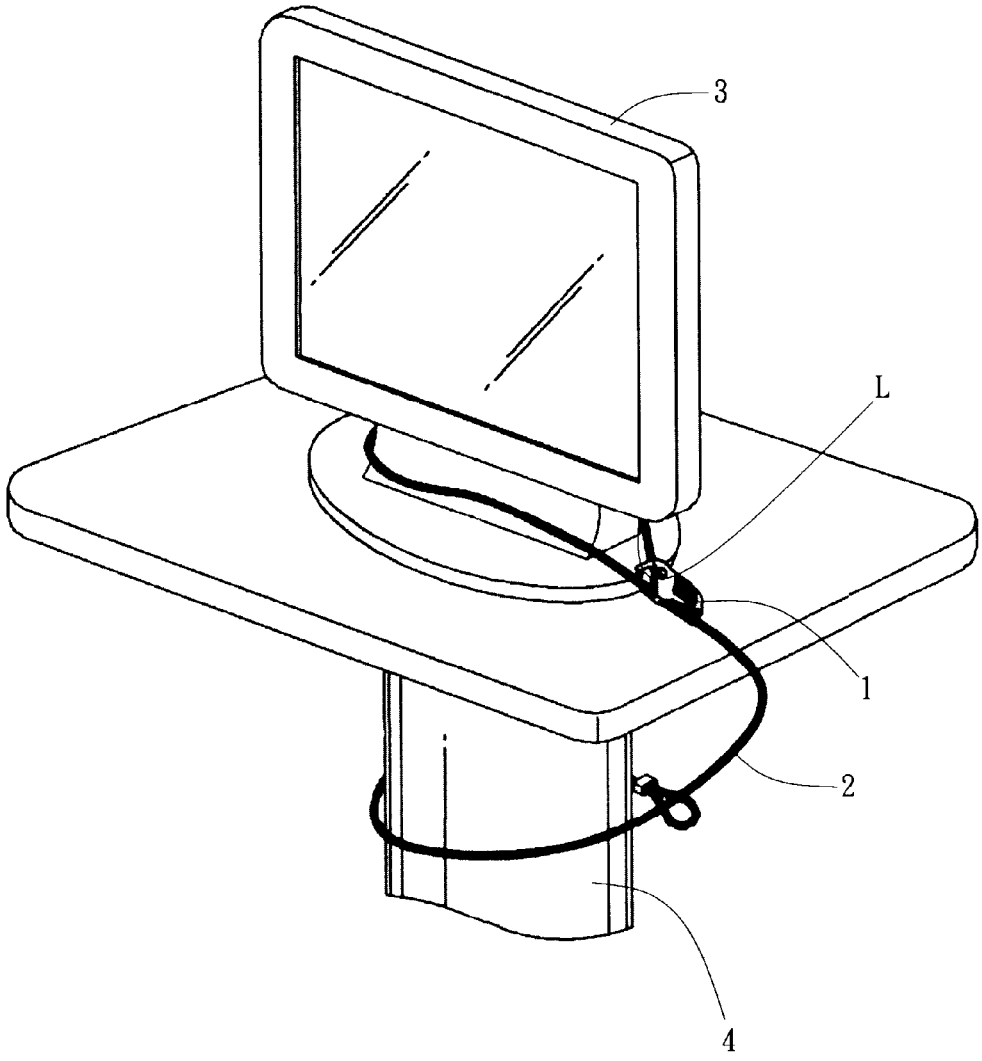
FIG. 1A(PRIORART)

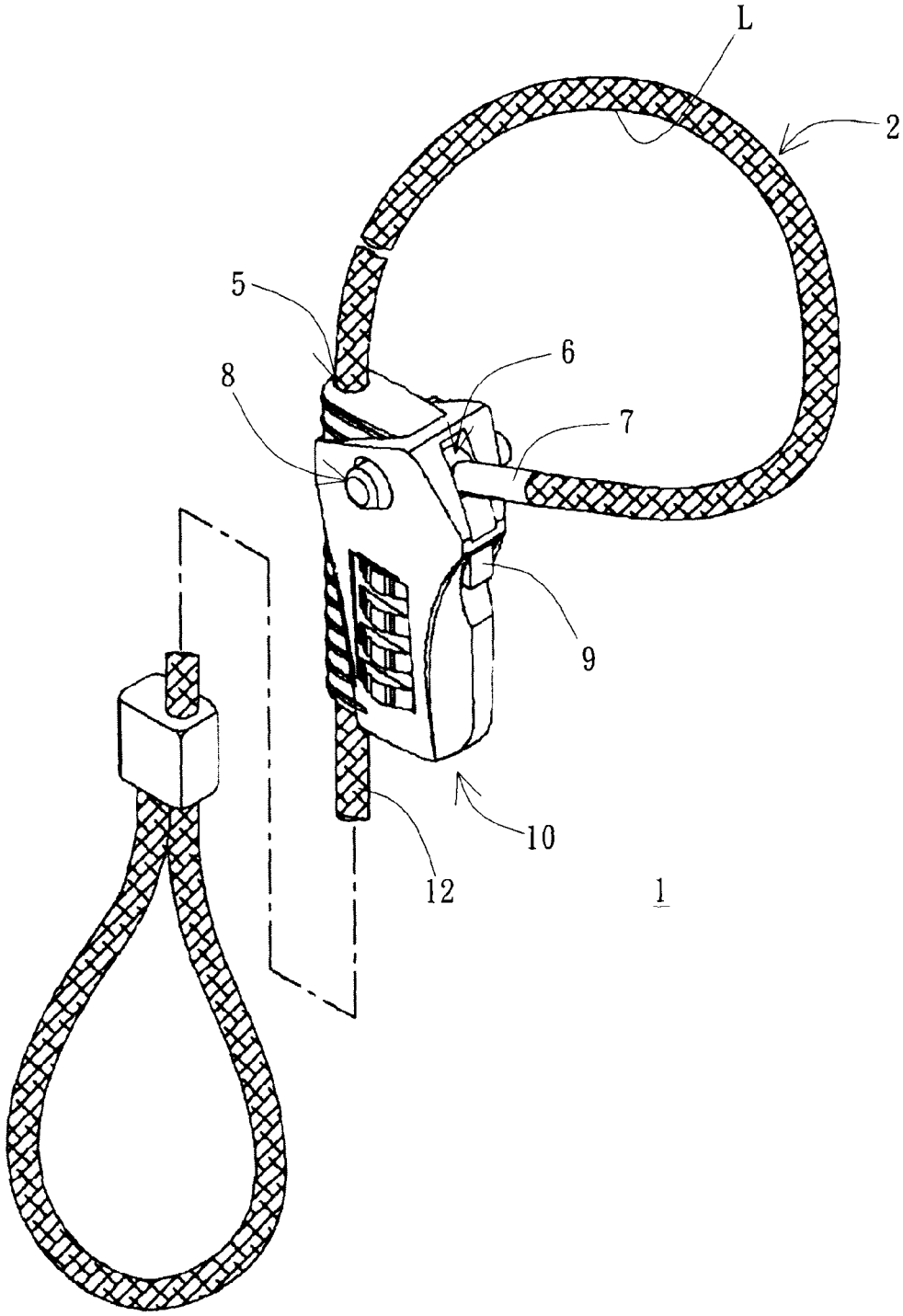
FIG. 1B(PRIORART)

CABLE LOCK

This application claims priority based on a U.S. Provisional Patent Application No. 61/173,991, filed on Apr. 30, 2009, the disclosure of which is incorporated herein by reference in its entirety.

BACKGROUND OF THE INVENTION

1. Field of the Invention

The present invention relates to a cable lock; particularly, the present invention relates to a cable lock having a cable capable of forming an adjustable loop to secure an object therein.

2. Description of the Related Art

The U.S. Pat. No. 6,470,718 (denoted as '718) of Yang discloses a cable lock composed mainly of a belt and a lock body. One end of the belt passes through one side of the lock body and is received in the other side of the lock body, so that a closed loop can be formed between the belt and the lock body to enclose an article therein. After the length of the closed loop is properly adjusted, the lock body is set to the locked condition and the article is secured.

However, in the cable lock disclosed in the patent '718, the belt can still be adjusted to shorten the length of the closed loop even if the lock body is in the locked condition. In other words, the closed loop can not be fixed in the proper length when the lock body is in the locked condition. As a result, the article secured in the closed loop is possibly damaged by the belt or the lock body while the belt is accidently pulled too tight. Therefore, the adjustability occurring after the cable lock is locked becomes problematic.

FIG. 1A is a schematic view of the use of the conventional cable lock in U.S. Pat. No. 7,104,093. As shown in FIG. 1A, the cable lock includes a lock body 1 and a belt 2. The lock body 1 and the belt 2 can be configured to form a closed loop L to secure an object 3 therein, so as to lock the object 3 to another object such as a table 4. FIG. 1B is a schematic view of the conventional cable lock shown in FIG. 1A. As shown in FIG. 1B, the lock body 1 includes a hole 5 for the belt 2 to pass therethrough and a slot 6 for receiving a buckle member 7 disposed on one end of the belt 2. A first clamp member 8 with a button disposed on the lock body 1 can be switched to retain the buckle member 7 in the slot 6 or to release the buckle member 7 therefrom. A second clamp member 9 with a button disposed on the lock body 1 can be switched to fix the belt 2 in the hole 5 or to release the belt 2 therefrom. When the first clamp member 8 and the second clamp member 9 are switched to fix the belt 2 in the hole 5 and the buckle member 7 in the slot 6, the closed loop L has a fixed length to eliminate the adjustability occurring as the cable lock is locked.

However, it is inconvenient for a user to operate two separate buttons of the cable lock, causing the increase of operation time. Moreover, the complicated structure of the cable lock may confuse the user and the respective functions of the buttons increase the possibility of maloperation.

SUMMARY OF THE INVENTION

It is an objective of the present invention to provide a cable lock, wherein in comparison with the prior arts, the operation mode of the cable lock of the present invention can be switched through a single switch.

The cable lock of the present invention includes a belt, a lock body, a first clamp unit, a second clamp unit, and a switch unit. The belt has a buckle unit at one end thereof. The lock body has a hole for the belt to pass therethrough and a slot for receiving the buckle unit, wherein the belt and the lock body are together capable of forming a closed loop. The first clamp unit and the second clamp unit are movably disposed in the lock body to fix the belt in the hole and retain the buckle unit in the slot, respectively. The switch unit is rotatably disposed on the lock body and capable of enabling the cable lock to operate in a locked mode, a clinched mode, or an unlocked mode. When the cable lock operates in the locked mode, the first clamp unit fixes the belt in the hole and the second clamp unit retains the buckle unit in the slot so that the closed loop has a fixed length. When the cable lock operates in the clinched mode, the first clamp unit releases the fixing of the belt to allow the closed loop to have an adjustable length. When the cable lock operates in the unlocked mode, the first clamp unit and the second clamp unit release the belt so that the belt can be detachable from the lock unit. A knob engaged with a rotatable body can be implemented as the switch unit to serve as a single switch for the user to select the operation mode of the cable lock, rather than a plurality of separate switches.

BRIEF DESCRIPTION OF THE DRAWINGS

FIG. 1A is a schematic view of the use of the conventional cable lock;

FIG. 1B is a schematic view of the conventional cable lock shown in FIG. 1A;

DETAILED DESCRIPTION OF THE PREFERRED EMBODIMENT

The present invention provides a cable lock. In a preferred embodiment, the cable lock can be utilized to secure an object or to fasten objects together.

Figure 2A:
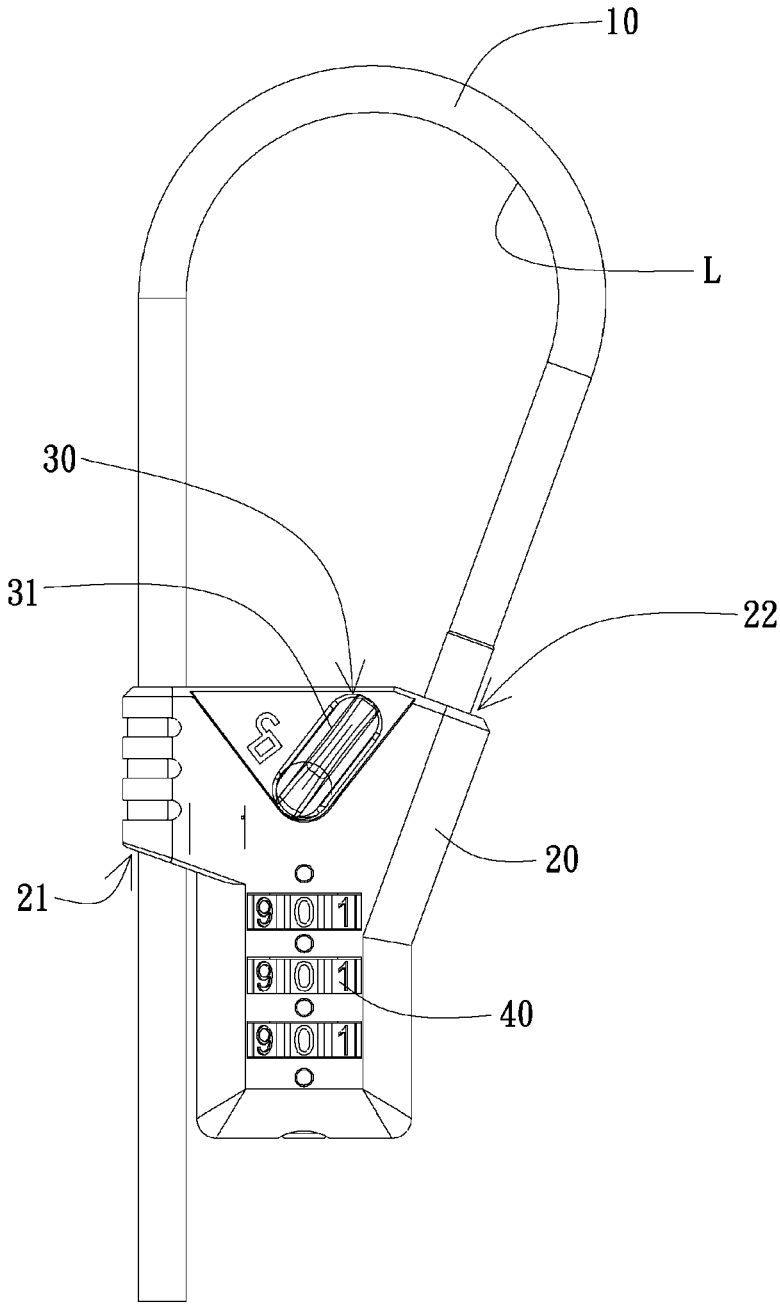
FIG. 2A is a schematic view of a first embodiment of the cable lock of the present invention in a locked mode.

FIG. 2A is a schematic view of a first embodiment of the cable lock of the present invention. As shown in FIG. 2A, the cable lock includes a belt 10, a lock body 20, a switch unit 30, and a lock mechanism 40. The belt 10 can be a cable or a steel rope with suitable length and flexibility, but is not limited thereto. The belt 10 can be connected to the lock body 20 so that the belt 10 and the lock body 20 are together capable of forming a closed loop L. The lock body 20 has a first receiving unit 21 for the belt 10 to pass therethrough and a second receiving unit 22 for receiving one end of the belt 10. The switch unit 30 includes a knob 31 exposed outside the lock body 20 and a rotatable body 32 (see FIG. 2B) disposed in the lock body 20. The knob 31 is provided for a user to select the operation mode of the cable lock. In this embodiment, the knob 31 can be switched among three positions so that the cable lock correspondingly operates in a locked mode (see FIG. 2B) to fix the length of the closed loop L, a clinched mode (see FIG. 4A) to allow the closed loop L to be adjustable, or an unlocked mode (see FIG. 4B) to release the belt 10 from the lock body 20. The knob 31 can rotate counterclockwise to switch the cable lock from the locked mode to the clinched mode, and then to the unlocked mode or rotate clockwise to switch the cable lock from the unlocked mode to the clinched mode, and then to the locked mode. The lock mechanism 40 for controlling the operability of the switch unit 30 is disposed on the lock body 20. Hereinafter, the structure and connections of each element of the cable lock will be described in detail.

Figure 2B:
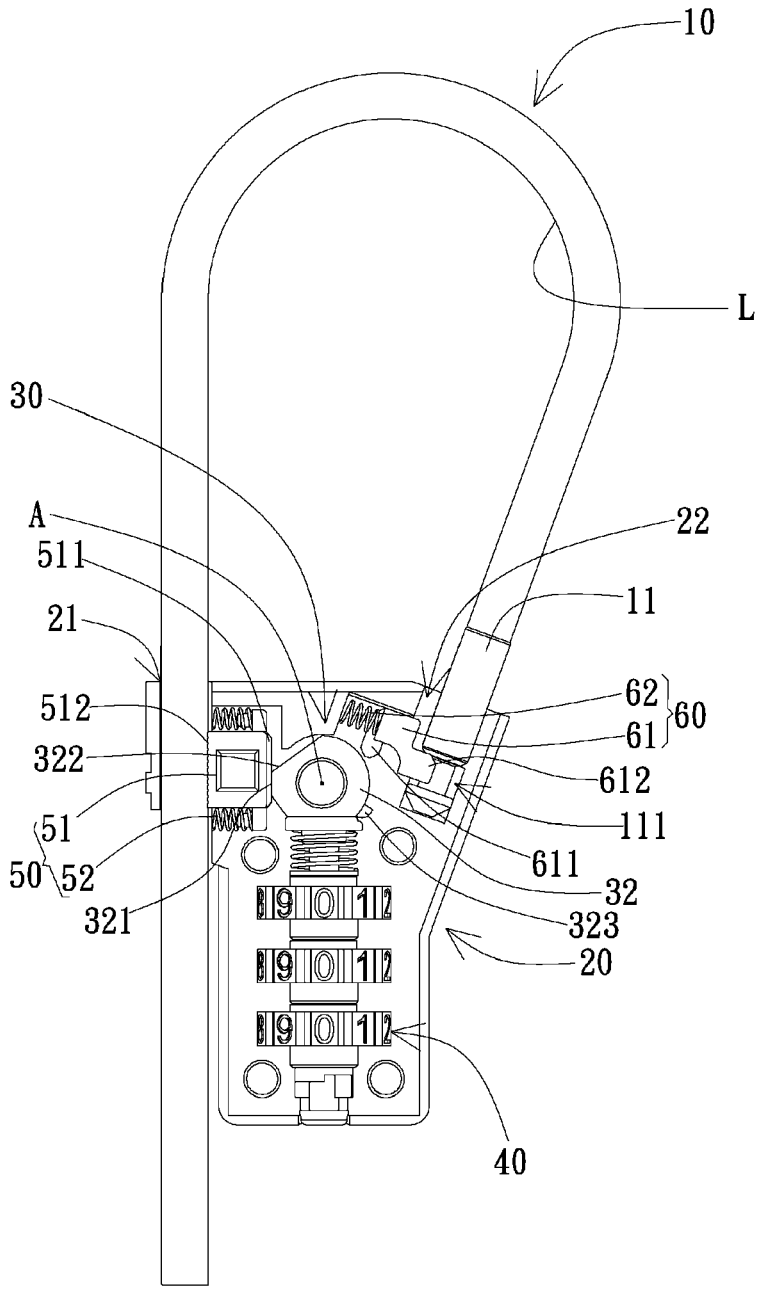
FIG. 2B is a schematic cross-sectional view of the cable lock shown in FIG. 2A.
Figure 2C:
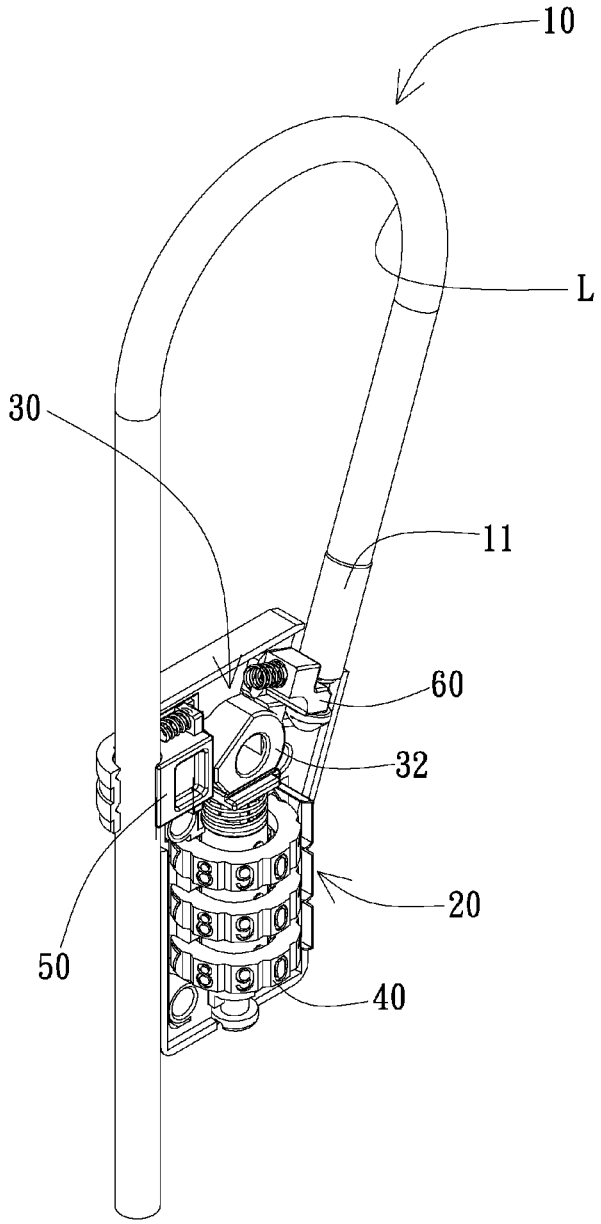
FIG. 2C is a schematic perspective view of the internal structure of the cable lock shown in FIG. 2B.

FIG. 2B is a schematic cross-sectional view of the structure of the cable lock shown in FIG. 2A. FIG. 2C is a perspective view of the internal structure of the cable lock shown in FIG. 2B. As shown in FIG. 2B and FIG. 2C, in this embodiment, the belt 10 has a buckle unit 11 at one end of the belt 10. At the other end of the belt 10, a ring (not shown) can be disposed so that the belt 10 can be secured on a fixed article. The lock body 20 can include a plurality of shell pieces constituting a housing for supporting and accommodating elements of the cable lock and has a first receiving unit 21 and a second receiving unit 22 on two opposite sides. In this embodiment, the first receiving unit 21 is a hole for the belt 10 to pass therethrough while the second receiving unit 22 is a slot for receiving the buckle unit 11, so that the belt 10 together with the lock body 20 are capable of forming the closed loop L.

Figure 3A:
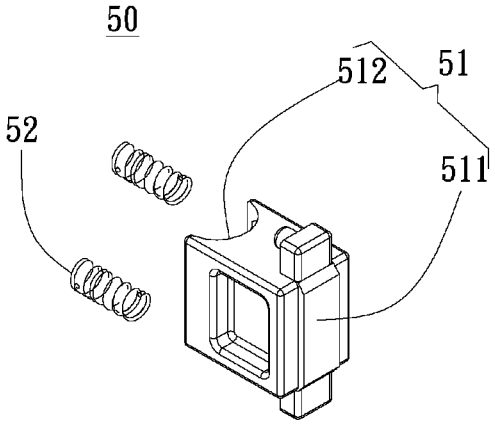
FIG. 3A is a schematic view of the first clamp unit of the cable lock shown in FIG. 2B.
Figure 3B:
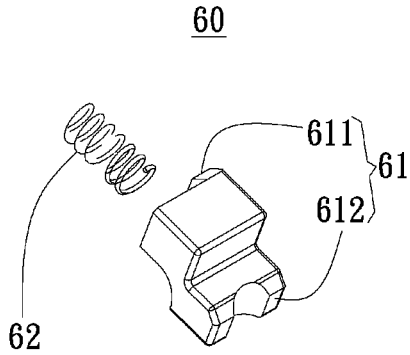
FIG. 3B is a schematic view of the second clamp unit of the cable lock shown in FIG. 2B.

As shown in FIG. 2B, a first clamp unit 50 and a second clamp unit 60 are also disposed inside the lock body 20. The first clamp unit 50 is movably disposed in the lock body 20 to fix the belt 10 in the hole 21 while the second clamp unit 60 is movably disposed in the lock body 20 to retain the buckle unit 11 in the slot 22. FIG. 3A is a schematic view of the first clamp unit 50 of the cable lock shown in FIG. 2B. As shown in FIG. 3A, the first clamp unit 50 includes a clamp body 51 and two resilient members 52. The clamp body 51 has a reacting surface 511 for interacting with the rotatable body 32 of the switch unit 30 and a clamp portion 512 for clamping the belt 10 in the hole 21. Each of the resilient members 52 is disposed to keep the clamp portion 512 away from the belt 10 when the reacting surface 511 is released from the interaction with the rotatable body 32 of the switch unit 30. In this embodiment, a spring is employed as the resilient member 52. FIG. 3B is a schematic view of the second clamp unit 60 of the cable lock shown in FIG. 2B. As shown in FIG. 3B, the second clamp unit 60 includes a clamp body 61 and a resilient member 62. The clamp body 61 has a protrusion 611 and a retaining portion 612 on two opposite ends. The protrusion 611 is provided for engaging with the rotatable body 32 of the switch unit 30 to allow the clamp body 61 to move along with the rotatable body 32 of the switch unit 30 while the retaining portion 612 is provided for interfering with the buckle unit 11. The resilient member 62 is disposed in a manner that the retaining portion 612 retains the buckle unit 11 in the slot 22 when the protrusion 611 is disengaged from the rotatable body 32 of the switch unit 30. Correspondingly, the buckle unit 11 has a recess 111 for the retaining portion 612 to be inserted thereinto when the buckle unit 11 is retained in the slot 22. In this embodiment, a spring is employed as the resilient member 62.

Figure 3C:
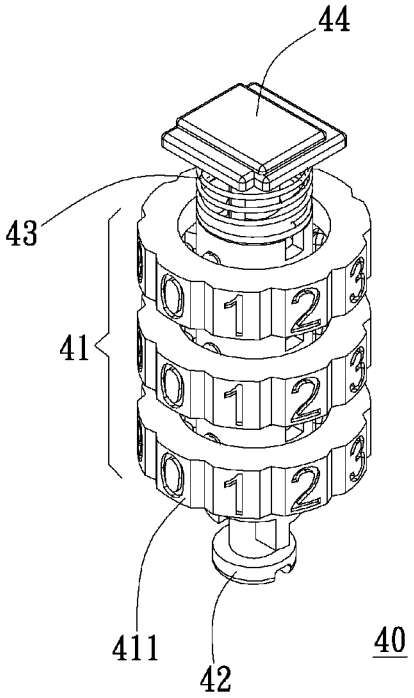
FIG. 3C is a schematic view of the lock mechanism of the cable lock shown in FIG. 2B.

As shown in FIGS. 2A, 2B and 2C, the knob 31 (as shown in FIG. 2A) is engaged with the rotatable body 32 to drive the rotation of the rotatable body 32. The rotatable body 32 can rotate to selectively interact with the first clamp unit 50 and the second clamp unit 60 so that the cable lock correspondingly operates in the locked mode, the clinched mode, and the unlocked mode. Moreover, as described above, the lock mechanism 40 is disposed on the lock body 20 and configured to control the operability of the switch unit 30. That is, the lock mechanism 40 controls the rotatability of the knob 31 and the rotatable body 32. FIG. 3C is a schematic view of the lock mechanism 40 of the cable lock shown in FIG. 2B. In the embodiment of FIG. 3C, the lock mechanism 40 includes a combination lock 41 having a plurality of dialing wheels 411, a shaft 42 capable of moving axially, and a resilient member 43. The shaft 42 is kept positioned by the resilient member 43 such as a spring and receives the dialing wheels 411 to confine the axial displacement of the shaft 42 so as to control the rotatability of the switch unit 30. For example, the dialing wheels 411 are exposed partly outside the lock body 20 to allow dialing, and with the dialing of the dialing wheels 411, the shaft 42 can be determined to be in an axially movable state or restricted to a fixed position. In addition, a latch block 44 extends from the top end of the shaft 42 for contacting the rotatable body 32 of the switch unit 30. For example, when the combination lock 41 is locked, the shaft 42 is fixedly positioned by the resilient member 43 to restrict the rotatability of the switch unit 30. That is, the shaft 42 is immovable in the axial direction and the knob 31 is not allowed to be operated by an unauthorized person to select the operation mode of the cable lock. When the combination lock 41 is unlocked by the user, the shaft 42 is axially movable, so that the knob 31 is rotatable and allowed to be operated to select the operation mode of the cable lock. In other embodiments, the lock mechanism 40 can include a key tube operated by a key to constitute a key lock, which can provide similar effect of the combination lock to control the operability, i.e. rotatability, of the switch unit 30. Since the structure and the operations of the combination lock and the key lock are well-known in the art, no further description will be elaborated. Hereinafter, the operations of the switch unit 30 in the case of the lock mechanism 40 being unlocked will be described in detail.

As described above, when the cable lock operates in the locked mode, the first clamp unit 50 fixes the belt 10 in the hole 21 and the second clamp unit 60 retains the buckle unit 11 in the slot 22 so that the closed loop L has a fixed length. As a result, an object enclosed between the belt 10 and the lock body 20 can be secured in the closed loop L. When the cable lock operates in the clinched mode, the first clamp unit 50 releases the fixing of the belt 10 to allow the closed loop L to have an adjustable length. That is, in the clinched mode, the length of the closed loop L can be adjusted by increasing or decreasing the length of the belt 10 passing through the hole 21 and between the hole 21 and the slot 22, so as to adjust the tightness of the object to be secured. When the cable lock operates in the unlocked mode, the first clamp unit 50 releases the fixing of the belt 10 and the second clamp unit 60 releases the buckle unit 11 so that the buckle unit 11 can be pulled out of the slot 22 and the entirety of the belt 10 can be detachable from the lock body 20. The relationship between the first and second clamp units 50, 60 and the switch unit 30 will be described below in detail.

As shown in FIGS. 2B and 2C, the rotatable body 32 has a rotation axis A and a plurality of portions of different radial length disposed around the rotation axis A. The plurality of portions of the rotatable body 32 selectively cooperate with the first clamp unit 50 and the second clamp unit 60 to enable the operation modes of the cable lock. The plurality of portions of the rotatable body 32 selectively cooperate with the first clamp unit 50 and the second clamp unit 60 under the control of the knob 31 and include a first pressing portion 321, a first release portion 322, and an engaging portion 323. As shown in FIG. 2B, the radial length of the first pressing portion 321 is longer than that of the first release portion 322. For example, in the embodiment of FIGS. 2B and 2C, when the knob 31 is rotated by the user to select the locked mode of the cable lock in the state that the belt 10 passes though the hole 21 and the buckle unit 11 is inserted into the slot 22, the rotatable body 32 engaged with the knob 31 is driven to rotate so that the first pressing portion 321 of the rotatable body 32 presses the first clamp unit 50, i.e. pushes the first clamp unit 50 against the belt 10 in the hole 21, to fix the belt 10 in the hole 21. That is, when the knob 31 is operated to enable the locked mode of the switch unit 30, the first pressing portion 321 of the rotatable body 32 contacts the reacting surface 511 of the clamp body 51 of the first clamp unit 50 and compresses the resilient members 52 to compel the clamp portion 512 opposite of the reacting surface 511 to tightly clamp the belt 10 in the hole 21 against the inner wall of the hole 21. Therefore, the belt 10 is immovable in the hole 21. In addition, the second clamp unit 60 is spaced apart from the rotatable body 32. That is, the second clamp unit 60 does not interfere with the rotatable body 32, wherein the resilient member 62 is relaxed and the retaining portion 612 of the clamp body 60 interferes with the recess 111 of the buckle unit 11 to retain the buckle unit 11 in the slot 22. In such a configuration, one end of the belt 10 is clamped by the first clamp unit 50 and the other end is restricted by the second clamp unit 60, so that the length of the closed loop L is fixed. As a result, the object enclosed within the closed loop L will not be further tightened and the damage of the object can be prevented.

Figure 4A:
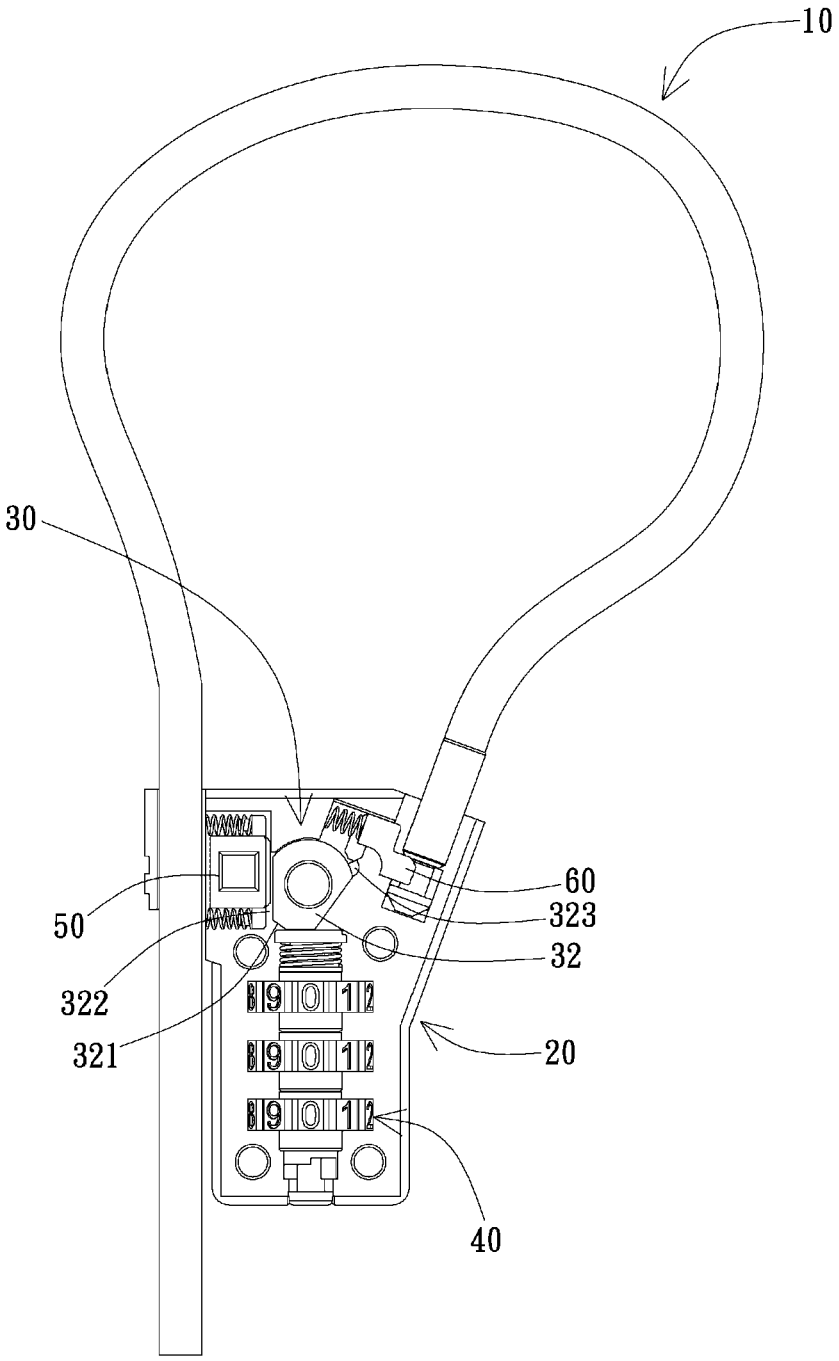
FIG. 4A is a schematic view of the cable lock shown in FIG. 2B in a clinched mode.
Figure 4B:
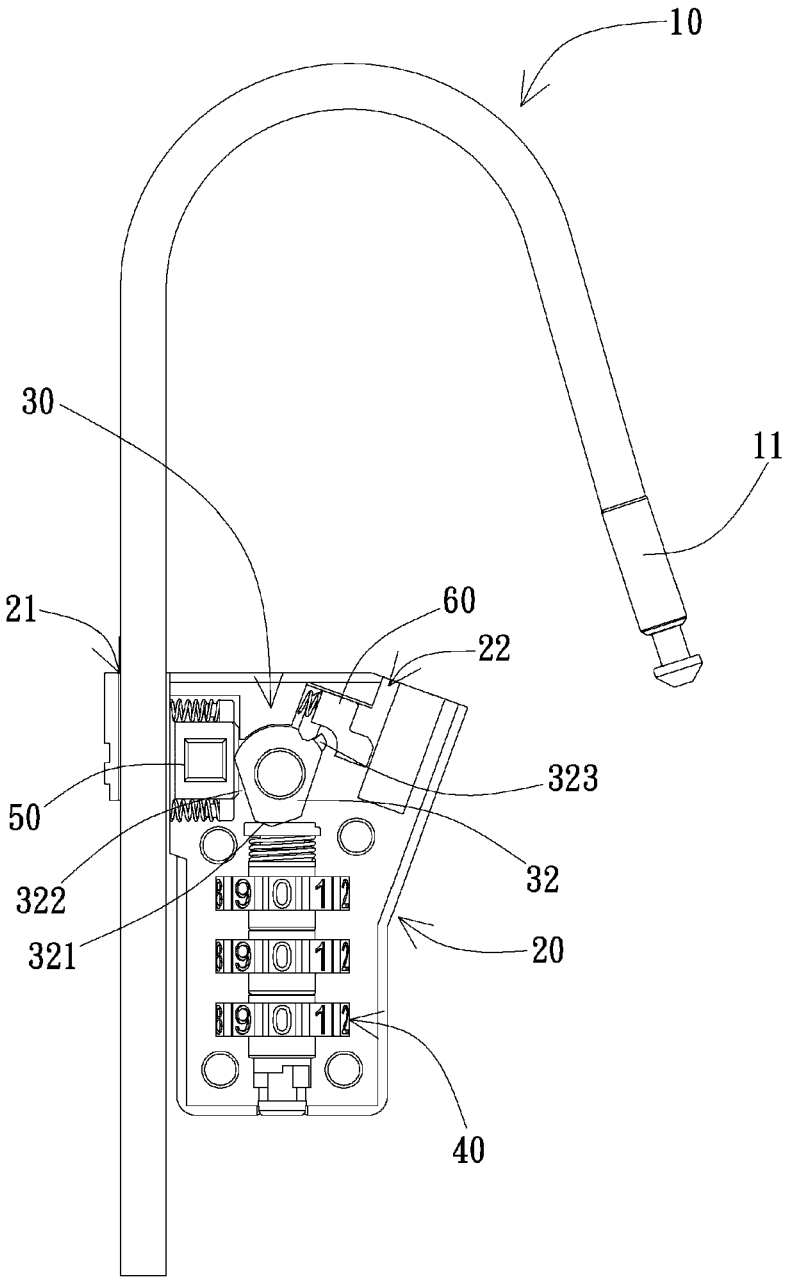
FIG. 4B is a schematic view of the cable lock shown in FIG. 2B in an unlocked mode.

As described, when the cable lock is in the clinched mode, the first clamp unit 50 releases the fixing of the belt 10 to allow the closed loop L to have an adjustable length, as shown in FIG. 4A. For example, when the knob 31 is operated by the user from the locked mode to the clinched mode, the rotatable body 32 engaged with the knob 31 is rotated to release the first clamp unit 50 from the pressing portion 321 to be spaced apart from the rotatable body 32. That is, when the knob 31 is operated to enable the clinched mode of the switch unit 30, the pressing portion 321 of the rotatable body 32 rotates away from the reacting surface 511 of the clamp body 51 and the release portion 322 of rotatable body 32 faces the reacting surface 511 of the clamp body 51. In such a configuration, the radial length of the release portion 322 smaller than that of the pressing portion 321 is selected in a manner that the release portion 322 preferably does not exert any pressing force onto the reacting surface 511 when the resilient member 52 is in the relaxation state. Therefore, when the release portion 322 of the rotatable body 32 is rotated to face the reacting surface 511 of the clamp body 51, the rotatable body 32 is spaced apart from the first clamp unit 50 and does not interfere with the first clamp body 50. That is, without the interference of the rotatable body 32, the compressed resilient member 52 will provide a restoring force to move the clamp portion 512 away from the belt 10, so that the belt 10 is movable in the hole 21. At this state, the second clamp unit 60 remains unaffected by the rotatable body 32 and the buckle unit 11 is still retained in the slot 22. In such a configuration, one end of the belt 10 is released from the restriction of the first clamp unit 50 and the other end is restricted by the second clamp unit 60, so that the length of the closed loop L can be adjustable. As a result, the adjustable length of the closed loop L can cope with the change in size of the object enclosed within the closed loop L and facilitate the usability of the cable lock. Moreover, after the closed loop L is adjusted with a suitable length in the clinched mode, the switch unit 30 can rotate to the locked mode to fix the length of the closed loop L.

As described above, when the cable lock is in the unlocked mode, the second clamp unit 60 releases the belt 10 so that belt 10 is detachable from the lock body 20. For example, in the embodiment of FIG. 4B, when the knob 31 is rotated by the user to select the unlocked mode of the cable lock, the rotatable body 32 engaged with the knob 31 is driven to rotate so that the engaging portion 323 is engaged with the second clamp unit 60 to disengage the second clamp unit 60 from the buckle unit 11. That is, when the knob 31 is operated to enable the unlocked mode of the switch unit 30, the rotatable body 32 rotates to allow the engaging portion 323 to engage with the protrusion 611 of clamp body 61 so that the clamp body 61 can be moved along with rotatable body 32. During the rotation of the rotatable body 32 from the clinched mode to the unlocked mode, the clamp body 61 moves to compress the resilient member 62 so that the retaining portion 612 of the clamp body 61 moves away from the recess 111 of the buckle unit 11 and releases the retaining of the buckle unit 11 in the slot 22. Therefore, the buckle unit 11 of the belt 10 can be removed from the slot 22, and the closed loop L no longer exists. In addition, during the rotation of the rotatable body 32 from the clinched mode to the unlocked mode, the release portion 322 of the rotatable body 32 rotates further and the first clamp unit 50 is still released from the interference of the pressing portion 321 of the rotatable body 32 so that the belt 10 can slide through the hole 21. At this state, with proper design of the hole 21 and the buckle unit 11, the belt 10 can be completely detached from the lock body 20. Consequently, the detachability of the belt 10 increases the usability and portability of the cable lock.

Moreover, when a detached belt 10 is intended to work with the lock body 20, the buckle end 11 of the belt 10 can pass through the hole 21 to surround the object and then is inserted into the slot 22 to enclose the object within the closed loop L. Subsequently, the knob 31 can be rotated to the clinched mode or the locked mode to allow the second clamp unit 60 to retain the buckle unit 11 in the slot 22. For example, when the knob 31 is rotated to the clinched mode from the unlocked mode, the rotatable body 32 is rotated to disengage from the second clamp unit 60, so that the second clamp unit 60 can engage with the buckle unit 11 and retain the buckle unit 11 in the slot 22. That is, when the knob 31 is rotated to the clinched mode from the unlocked mode, the rotatable body 32 is rotated in a manner that the engaging portion 323 of rotatable body 32 is disengaged from the protrusion 611, so that the compressed resilient member 62 provides a restoring force to move the clamp body 61 toward the slot 22 and enable the retaining portion 612 to be inserted into the slot 22 to interfere with the recess 111 of the buckle unit 11 and retain the buckle unit 11 in the slot 22. Moreover, as described above, after the closed loop L is adjusted with a suitable length in the clinched mode, the switch unit 30 can rotate to the locked mode to fix the length of the closed loop L.

Compared to the prior arts, the cable lock of the present invention can be operated in different modes by simply operating the knob 31 of the switch unit 30 and provide the advantages of reducing the complexities of the operation and saving the operation time.

In the embodiment of FIG. 2A, the cable lock can be operated in three different modes; however, in other embodiments, by changing the design of some elements of the cable lock, such as the rotatable body, the first clamp unit, or the second clamp unit, the number of operation modes can be changed as desired. For instance, the rotatable body can be modified in a manner that the pressing portion releases the interference with the first clamp unit only when the engaging portion is engaged with the second clamp unit. In such a modification, the cable lock can be operated only in two modes, i.e. the locked mode and the unlocked mode.

Figure 5:
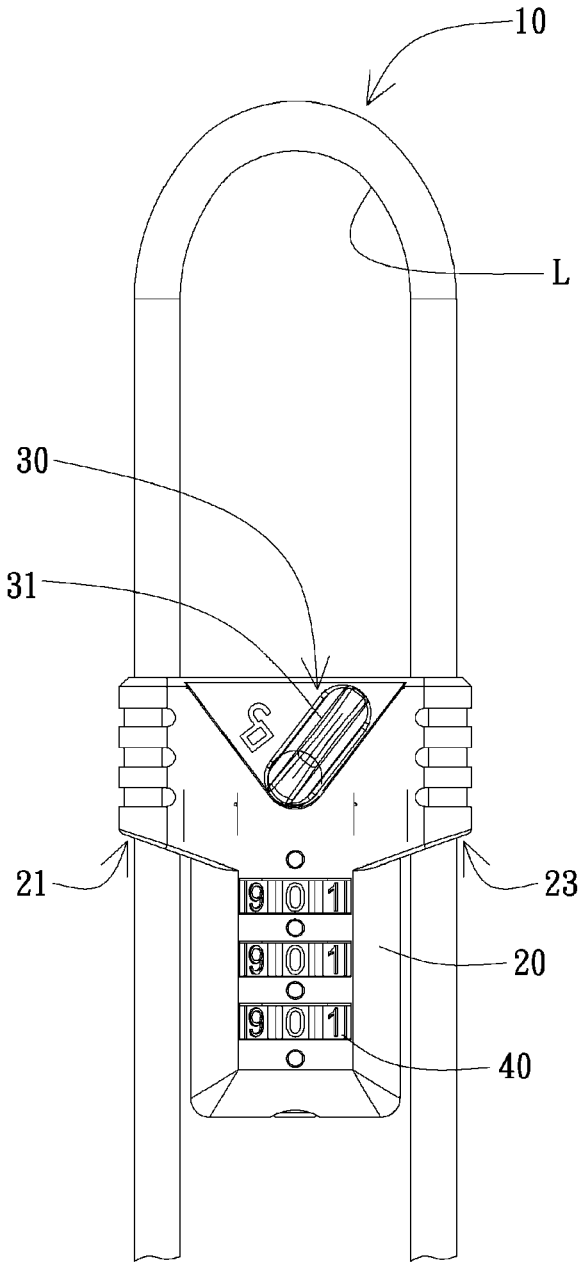
FIG. 5 is a schematic view of a second embodiment of the cable lock of the present invention in a locked mode.

FIG. 5 is a schematic view of a second embodiment of the cable lock of the present invention, wherein the cable lock is operable in two different modes. As shown in FIG. 5, the cable lock includes a belt 10, a lock body 20, a switch unit 30, and a lock mechanism 40. The belt 10 is similar to the belt of the first embodiment and can be a cable or a steel rope with suitable length and flexibility. The belt 10 and the lock body 20 are together capable of forming a closed loop L. The lock body 20 has a first receiving unit 21 and a second receiving unit 23 on two opposite sides for the belt 10 to pass therethrough. The switch unit 30 includes a knob 31 exposed outside the lock body 20 and a rotatable body 32 (see FIG. 6A) disposed in the lock body 20. The knob 31 is provided for a user to select the operation mode of the cable lock. In this embodiment, the knob 31 can be switched between two positions so that the cable lock correspondingly operates in a locked mode (see FIG. 6A) to fix the length of the closed loop Lor an unlocked mode (see FIG. 6B) to release the belt 10 from the lock body 20. The knob 31 can rotate counterclockwise to switch the cable lock from the locked mode to the unlocked mode or rotate clockwise to switch the cable lock from the unlocked mode to the locked mode. The lock mechanism 40 for controlling the operability of the switch unit 30 is disposed on the lock body 20 and is similar to the lock mechanism of the first embodiment. Accordingly, the structure and relationships of the lock mechanism 40 and the switch unit 30 will not be elaborated hereinafter.

Figure 6A:
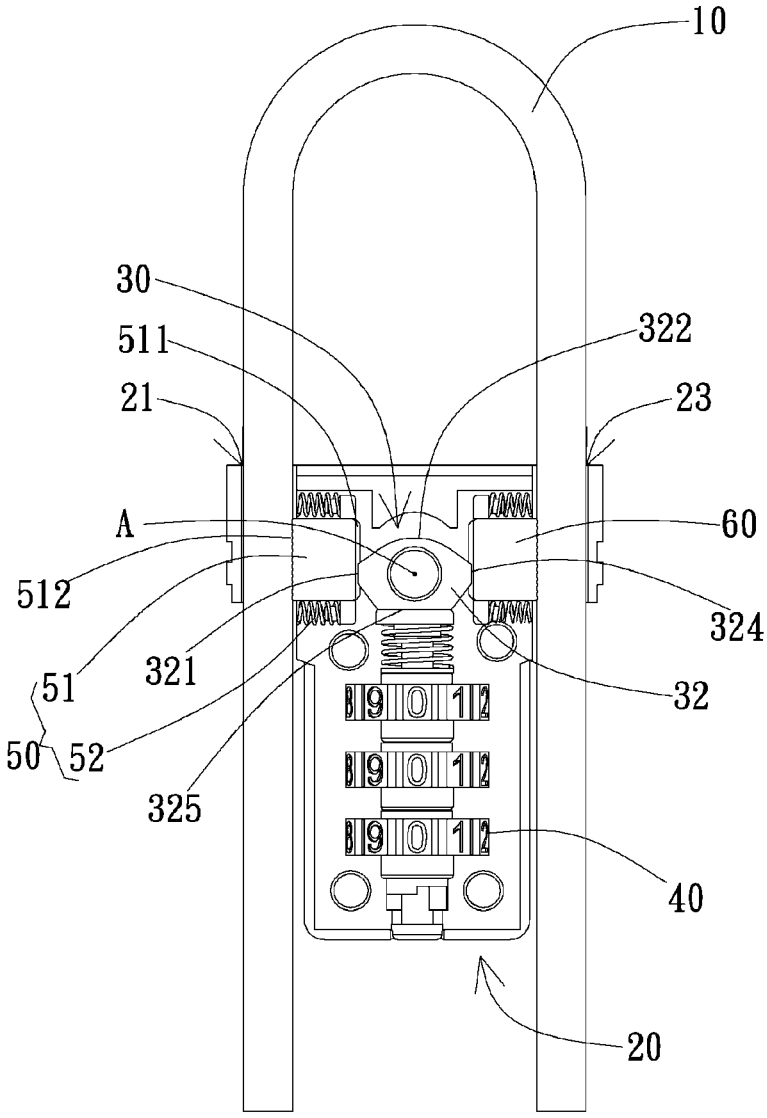
FIG. 6A is a schematic cross-sectional view of the cable lock shown in FIG. 5.

As shown in FIG. 6A, the lock body 20 has a first receiving unit 21 and a second receiving unit 23. In this embodiment, the first receiving unit 21 and the second receiving unit 23 are both designed as a hole for the belt 10 to pass therethrough. That is, one end of the belt 10 can pass through a first hole on one side of the lock body 20 which serves as the first receiving unit 21 and then through a second hole on the other side of the lock body 20 which serves as the second receiving unit 23, so that the closed loop L can be formed. Similar to the first embodiment, a first clamp unit 50 and a second clamp unit 60 are disposed inside the lock body 20. In this embodiment, the first clamp unit 50 and the second clamp unit 60 are both movably disposed in the lock body 20 and configured to fix the belt 10 in the holes 21 and 23, respectively. In other words, the structure and the functions of the first clamp unit 50 and the second clamp unit 60 are identical to that of the first clamp unit 50 in the first embodiment of the present invention and will not be elaborated.

Referring to FIG. 6A, the knob 31 (as shown in FIG. 5) is engaged with the rotatable body 32 to drive the rotation of the rotatable body 32. The rotatable body 32 can rotate to selectively interact with the first clamp unit 50 and the second clamp unit 60 so that the cable lock correspondingly operates in the locked mode and the unlocked mode. Hereinafter, the operations of the switch unit 30 in the case of the lock mechanism 40 being unlocked will be described in detail. As described above, when the cable lock operates in the locked mode, the first clamp unit 50 fixes the belt 10 in the hole 21 and the second clamp unit 60 fixes the belt 10 in the hole 23 so that the closed loop L has a fixed length. As a result, an object enclosed between the belt 10 and the lock body 20 can be secured in the closed loop L. When the cable lock operates in the unlocked mode, the first clamp unit 50 and the second clamp unit 60 release the belt 10 so that the belt 10 can be detachable from the lock body 20. The relationship between the first and second clamp units 50, 60 and the switch unit 30 will be described below in detail.

As shown in FIG. 6A, the rotatable body 32 has a rotation axis A and a plurality of portions of different radial length disposed around the rotation axis A. The plurality of portions of the rotatable body 32 selectively cooperate with the first clamp unit 50 and the second clamp unit 60 to enable the operation modes of the cable lock. The plurality of portions selectively cooperate with the first clamp unit 50 and the second clamp unit 60 under the control of the knob 31 (as shown in FIG. 5) and include a first pressing portion 321, a first release portion 322, a second pressing portion 324, and a second release portion 325.

As shown in FIG. 6A, the radial length of the first pressing portion 321 is longer than that of the first release portion 322 while the radial length of the second pressing portion 324 is longer than that of the second release portion 325. For example, in the embodiment of FIGS. 5 and 6A, when the knob 31 is rotated by the user to select the locked mode of the cable lock in the state that the belt 10 passes through the holes 21 and 23, the rotatable body 32 engaged with the knob 31 is driven to rotate so that the first pressing portion 321 of the rotatable body 32 presses the first clamp unit 50, i.e. pushes the first clamp unit 50 against the belt 10 in the hole 21, to fix the belt 10 in the hole 21. That is, when the knob 31 is operated to enable the locked mode of the switch unit 30, the first pressing portion 321 of the rotatable body 32 contacts the reacting surface 511 of the clamp body 51 of the first clamp unit 50 and compresses the resilient members 52 to compel the clamp portion 512 opposite of the reacting surface 511 to tightly clamp the belt 10 in the hole 21 against the inner wall of the hole 21. Therefore, the belt 10 is immovable in the hole 21. At the same time, in a similar way, the second pressing portion 324 of the rotatable body 32 presses the second clamp unit 60, i.e. pushes the second clamp unit 60 against the belt 10 in the hole 23, to fix the belt 10 in the hole 23. Therefore, the belt 10 is immovable in the hole 23. That is, the first pressing portion 321 and the second pressing portion 324 are preferably disposed on opposite sides corresponding to the first and the second receiving units 21, 23 and respectively have a radial length capable of interfering with the first and second clamp units 50, 60 when the knob 31 rotates to the locked mode. In such a configuration, a first portion of the belt 10 is clamped by the first clamp unit 50 and a second portion of the belt 10 is clamped by the second clamp unit 60, so that the length of the closed loop L is fixed. As a result, the object enclosed within the closed loop L will not be further tightened and the damage of the object can be prevented.

As described above, when the cable lock is in the unlocked mode, the first and the second clamp units 50, 60 release the belt 10 so that the belt 10 is detachable from the lock body 20. For example, in the embodiment of FIG. 6B, when the knob 31 is rotated by the user to select the unlocked mode of the cable lock, the rotatable body 32 engaged with the knob 31 is driven to rotate so that the first and second clamp units 50, 60 are spaced apart from the rotatable body 32 and release the fixing of the belt 10 to allow the belt 10 to be detachable from the lock body 20 or to allow the length of the closed loop L to be adjustable. That is, when the knob 31 is operated to enable the unlocked mode of the switch unit 30, the first pressing portion 321 of the rotatable body 32 rotates away from the reacting surface 511 of the clamp body 51 and the first release portion 322 of the rotatable body 32 faces the reacting surface 511 of the clamp body 51. At the same time, in a similar way, the second pressing portion 324 rotates away from the second clamp unit 60 and the second release portion 325 faces the second clamp unit 60. In such a configuration, the radial length of the release portions 322, 325 smaller than that of the pressing portions 321, 324 is selected in a manner that the release portions 322, 325 preferably do not exert any pressing force onto the first and second clamp units 50, 60 when the resilient members thereof are in the relaxation state. Therefore, without the interference of the rotatable body 32, the compressed resilient members will provide a restoring force to move the clamp portions of the clamp units 50, 60 away from the belt 10, so that the belt 10 is movable in the holes 21, 23. In other words, when the cable lock is in the unlocked mode, by pulling either end of the belt 10, the length of the closed loop L can be adjusted or the belt 10 can be completely detached from the lock body 20. Consequently, the adjustability and detachability of the belt 10 increase the usability and portability of the cable lock.

Figure 6B:
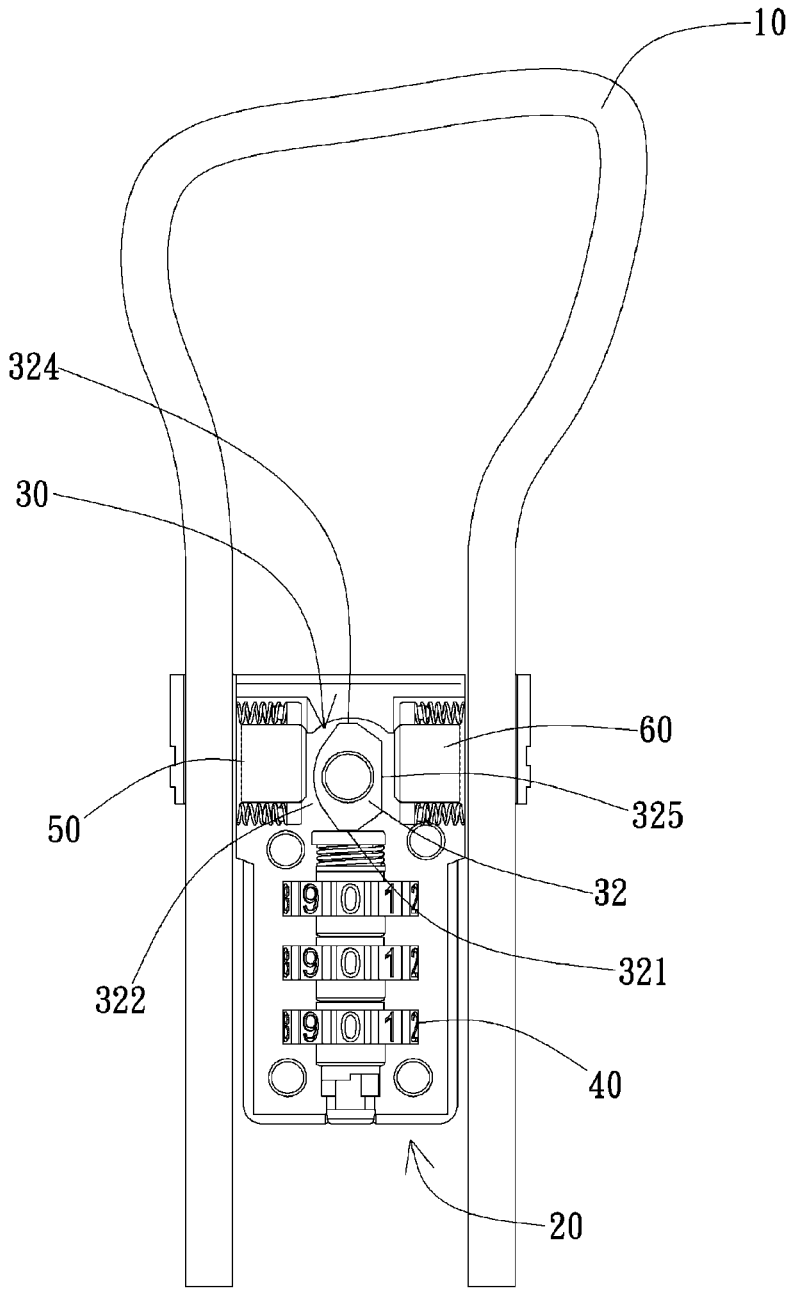
FIG. 6B is a schematic view of the cable lock shown in FIG. 6A in an unlocked mode.

In the embodiment of FIGS. 5, 6A, and 6B, the cable lock can be operated in two different modes; however, in other embodiments, by changing the design of the rotatable body 32, the first clamp unit 50, or the second clamp unit 60, the number of operation modes can be changed as desired. For instance, the rotatable body can be modified in a manner that the first pressing portion and the second pressing portion are disposed not opposite to each other. That is, the design of the portions of different radial length disposed around the rotation axis A of the rotatable body 32 can be changed so that the cable lock can operate in a clinched mode as the first embodiment of the present invention.

Additionally, in other embodiments of the present invention, the first receiving unit and the second receiving unit can be respectively a slot so as to receive two ends of a belt with a buckle unit at each ends. At the mean time, the design of the rotatable body 32, the first clamp unit 50, and the second clamp unit 60 have to be changed correspondingly.

Although the present invention has been described through the above-mentioned related embodiments, the above-mentioned embodiments are merely the examples for practicing the present invention. What needs to be indicated is that the disclosed embodiments are not intended to limit the scope of the present invention. On the contrary, the modifications within the essence and the scope of the claims and their equivalent dispositions are all contained in the scope of the present invention.

What is claimed is:

1. A cable lock, comprising:

a belt;

a lock body having a first receiving unit for receiving a first portion of the belt and a second receiving unit for receiving a second portion of the belt, wherein the belt and the lock body are together capable of forming a closed loop;

a first clamp unit, movably disposed in the lock body, for fixing the belt on the first receiving unit;

a second clamp unit, movably disposed in the lock body, for fixing the belt on the second receiving unit; and a switch unit, including a knob rotatably formed on the lock body for a user to select the mode of the switch unit and a rotatable body disposed in the lock body, wherein the knob is engaged with the rotatable body to drive the rotation of the rotatable body so that the switch unit is capable of operating in a locked mode and an unlocked mode, and the rotatable body has a rotation axis and a plurality of portions of different radial length disposed around the rotation axis, wherein the plurality of portions include a first pressing portion and a first release portion and selectively cooperate with the first clamp unit and the second clamp unit under control of the knob, wherein when the switch unit operates in the locked mode, the first clamp unit fixes the first portion of the belt on the first receiving unit and the second clamp unit fixes the second portion of the belt on the second receiving unit so that the closed loop has a fixed length; and wherein when the switch unit operates in the unlocked mode, the second clamp unit releases the belt so that the belt is detachable from the lock body.

2. The cable lock of claim 1, wherein the switch unit is further capable of operating in a clinched mode, so that the first clamp unit releases the fixing of the belt to allow the closed loop to have an adjustable length.

3. The cable lock of claim 1, wherein the radial length of the first pressing portion is longer than that of the first release portion.

4. The cable lock of claim 3, wherein the first receiving unit includes a hole for the belt to pass therethrough, when the knob is operated to enable the locked mode of the switch unit, the first pressing portion of the rotatable body pushes the first clamp unit against the first portion of the belt in the hole.

5. The cable lock of claim 4, wherein the switch unit is further capable of operating in a clinched mode, when the knob is operated to enable the clinched mode of the switch unit, the rotatable body is rotated to release the first clamp unit from the first pressing portion so that the rotatable body does not interfere with the first clamp unit.

6. The cable lock of claim 3, wherein the plurality of portions further include an engaging portion, the belt has a buckle unit at one end thereof, when the knob is operated to enable the unlocked mode of the switch unit, the rotatable body is rotated to release the first clamp unit from the first pressing portion to the first release portion and the engaging portion is engaged with the second clamp unit to disengage the second clamp unit from the buckle unit.

7. The cable lock of claim 3, wherein the plurality of portions further include a second pressing portion and a second release portion, the radial length of the second pressing portion is longer than that of the second release portion, when the knob is operated to enable the unlocked mode of the switch unit, the rotatable body is rotated to release the first clamp unit from the first pressing portion to the first release portion and release the second clamp unit from the second pressing portion to the second release portion.

8. The cable lock of claim 1, wherein the first receiving unit includes a hole for the belt to pass therethrough, the first clamp unit includes a clamp body and a resilient member, the clamp body has a reacting surface for interacting with the first pressing portion of the rotatable body and a clamp portion for clamping the belt in the hole, the resilient member is disposed opposite to the first pressing portion with respect to the reacting surface to keep the clamp portion away from the belt when the reacting surface is released from the interaction with the first pressing portion.

9. The cable lock of claim 1, wherein the belt has a buckle unit at one end thereof, the second receiving unit includes a slot for receiving the buckle unit, the plurality of portions further include an engaging portion, the second clamp unit includes a clamp body and a resilient member, the clamp body has a protrusion for engaging with the engaging portion to allow the clamp body to move along with the rotatable body and a retaining portion for interfering with the buckle unit, the resilient member is disposed in a manner that the retaining portion retains the buckle unit in the slot when the protrusion is disengaged from the engaging portion of the rotatable body.

10. The cable lock of claim 9, wherein the buckle unit has a recess, the retaining portion is inserted into the recess when the buckle unit is retained in the slot.

11. The cable lock of claim 1, wherein the second receiving unit includes a hole for the belt to pass therethrough, the second clamp unit includes a clamp body and a resilient member, the plurality of portions further include a second pressing portion, the clamp body has a reacting surface for interacting with the second pressing portion of the rotatable body and a clamp portion for clamping the belt in the hole, the resilient member is disposed opposite to the second pressing portion with respect to the reacting surface to keep the clamp portion away from the belt when the reacting surface is released from the interaction with the second pressing portion.

12. The cable lock of claim 1, wherein a lock mechanism is disposed on the lock body and configured to control the rotatability of the switch unit.

13. The cable lock of claim 12, wherein the lock mechanism includes a combination lock having a plurality of dialing wheels, a shaft capable of moving axially, and a resilient member, wherein the shaft is kept positioned by the resilient member and works with the dialing wheels to confine the axial displacement of the shaft so as to control the rotatability of the switch unit.

14. A cable lock, comprising:

a belt;

a lock body having a first receiving unit for receiving a first portion of the belt and a second receiving unit for receiving a second portion of the belt, wherein the belt and the lock body are together capable of forming a closed loop;

a first clamp unit, movably disposed in the lock body, for fixing the first portion of the belt on the first receiving unit;

a second clamp unit, movably disposed in the lock body, for fixing the second portion of the belt on the second receiving unit;

a switch unit including a rotatable body rotatably disposed in the lock body and a knob rotatably formed on the lock body and engaged with the rotatable body, wherein the knob is provided for a user to drive the rotatable body to rotate; and a lock mechanism, disposed on the lock body, for controlling the rotatability of the switch unit;

wherein when the cable lock is in a locked mode, the rotatable body presses the first clamp unit to fix the first portion of the belt on the first receiving unit and the second clamp unit fixes the second portion of the belt on the second receiving unit; and wherein when the cable lock is in an unlocked mode, the first clamp unit is released from interference of the rotatable body and the second clamp unit releases the second portion of the belt so that the belt is detachable from the cable lock.

15. The cable lock of claim 14, wherein the belt has a buckle unit at one end thereof, the second receiving unit includes a slot for receiving the buckle unit, when the cable lock is in the locked mode, the second clamp unit is spaced apart from the rotatable body to retain the buckle unit in the slot, when the cable lock is in the unlocked mode, the rotatable body is engaged with the second clamp unit to allow the buckle unit to be removable from the slot.

16. The cable lock of claim 14, wherein when the cable lock is in the unlocked mode, the rotatable body is spaced apart from the first clamp unit and the second clamp unit.

17. The cable lock of claim 14, wherein the second receiving unit includes a hole for the belt to pass therethrough, when the cable lock is in the locked mode, the rotatable body presses the second clamp unit, when the cable lock is in the unlocked mode, the rotatable body is spaced apart from the second clamp unit.

18. The cable lock of claim 17, wherein the second clamp unit includes a clamp body and a resilient member, the clamp body has a reacting surface for interacting with the rotatable body and a clamp portion for clamping the belt in the second receiving unit, the resilient member is disposed opposite to the rotatable body with respect to the reacting surface.

19. The cable lock of claim 14, wherein the rotatable body has a rotation axis and a plurality of portions of different radial length disposed around the rotation axis, wherein the plurality of portions selectively cooperate with the first clamp unit and the second clamp unit to enable the mode of the cable lock.

20. The cable lock of claim 14, wherein the first clamp unit includes a clamp body and a resilient member, the clamp body has a reacting surface for interacting with the rotatable body and a clamp portion for clamping the belt in the first receiving unit, the resilient member is disposed opposite to the rotatable body with respect to the reacting surface.

21. The cable lock of claim 15, wherein the second clamp unit includes a clamp body and a resilient member, the clamp body has a protrusion for engaging with the rotatable body and a retaining portion for interfering with the buckle unit, the resilient member is disposed in a manner that the retaining portion retains the buckle unit in the slot when the protrusion is disengaged from the rotatable body.

* * * * *